US011753270B1

(12) United States Patent
Nalder

(10) Patent No.: US 11,753,270 B1
(45) Date of Patent: Sep. 12, 2023

(54) FIREHOSE WINDER

(71) Applicant: Richard Nalder, Minden, NV (US)

(72) Inventor: Richard Nalder, Minden, NV (US)

( * ) Notice: Subject to any disclaimer, the term of this patent is extended or adjusted under 35 U.S.C. 154(b) by 38 days.

(21) Appl. No.: 16/602,075

(22) Filed: Jul. 30, 2019

Related U.S. Application Data

(60) Provisional application No. 62/764,398, filed on Jul. 31, 2018.

(51) Int. Cl.
*B65H 54/58* (2006.01)
*A62C 33/04* (2006.01)

(52) U.S. Cl.
CPC ..... *B65H 54/585* (2013.01); *A62C 33/04* (2013.01); *B65H 2701/332* (2013.01)

(58) Field of Classification Search
CPC ..... B65H 54/58; B65H 54/585; B65H 2701/332; A62C 33/04
See application file for complete search history.

(56) References Cited

U.S. PATENT DOCUMENTS

| | | | | |
|---|---|---|---|---|
| 5,205,509 | A * | 4/1993 | Noggle | B65H 54/585 242/406 |
| 5,988,559 | A | 11/1999 | Gnass | |
| 6,206,317 | B1 | 3/2001 | Harvestine | |
| 6,267,319 | B1 | 7/2001 | Hoffmann et al. | |
| 6,659,389 | B1 | 12/2003 | Hoffmann et al. | |
| 10,308,471 | B2 | 6/2019 | Harrold | |
| 2017/0129734 | A1* | 5/2017 | Harrold | A62C 33/00 |

* cited by examiner

*Primary Examiner* — Sang K Kim
(74) *Attorney, Agent, or Firm* — Kenneth D'Alessandro

(57) ABSTRACT

A firehose winding apparatus having at least one pair of opposing arms. Each opposing arm has a flanged member at one end of the opposing arm and an attachment point at the other end. A central hub member attached to the pair of opposing arms at the attachment point of each opposing arm so that the arms extend from the central hub member. For foldable arms, a locking pin is secured to each opposing arm. A central pin extends from a vertical member that provides vertical support for the firehose winding apparatus and provides an axis of rotation about which the opposing arms and central hub member rotate.

9 Claims, 14 Drawing Sheets

FIREHOSE WINDER

FIELD OF THE INVENTION

The present invention relates broadly to firefighting equipment, and more specifically to winding firehoses into portable coils.

BACKGROUND OF THE INVENTION

Firehoses are the primary tool for firefighters. Firefighters are trained to use firehoses in a variety of settings and are constantly unwinding and rewinding empty firehoses in a variety of rolls and large coils for storage or transportation. In certain firefighting applications, such as fighting large vegetation fires, firehoses may be connected together in lengths that span miles to deliver water to the scene of a fire. Coiled firehoses need to be small enough that they can be earned on the backs of firefighters in some cases; in other instances, the coils can be larger and placed on firetrucks and other vehicles. In any instance, the firehose is wound up after use. This is a mostly a manual process with few practicable alternatives in the field or fire station.

SUMMARY OF THE INVENTION

The present invention provides a firehose winding apparatus having at least one pair of opposing arms. Each opposing arm has a flanged member at one end of the opposing arm and an attachment point at the other end. A central hub member attached to the pair of opposing arms at the attachment point of each opposing arm so that the arms extend from the central hub member. For foldable arms, a locking pin is secured to each opposing arm. A central pin extends from a vertical member that provides vertical support for the firehose winding apparatus and provides an axis of rotation about which the opposing arms and central hub member rotate.

DETAILED DESCRIPTION OF THE INVENTION

Figure 1:
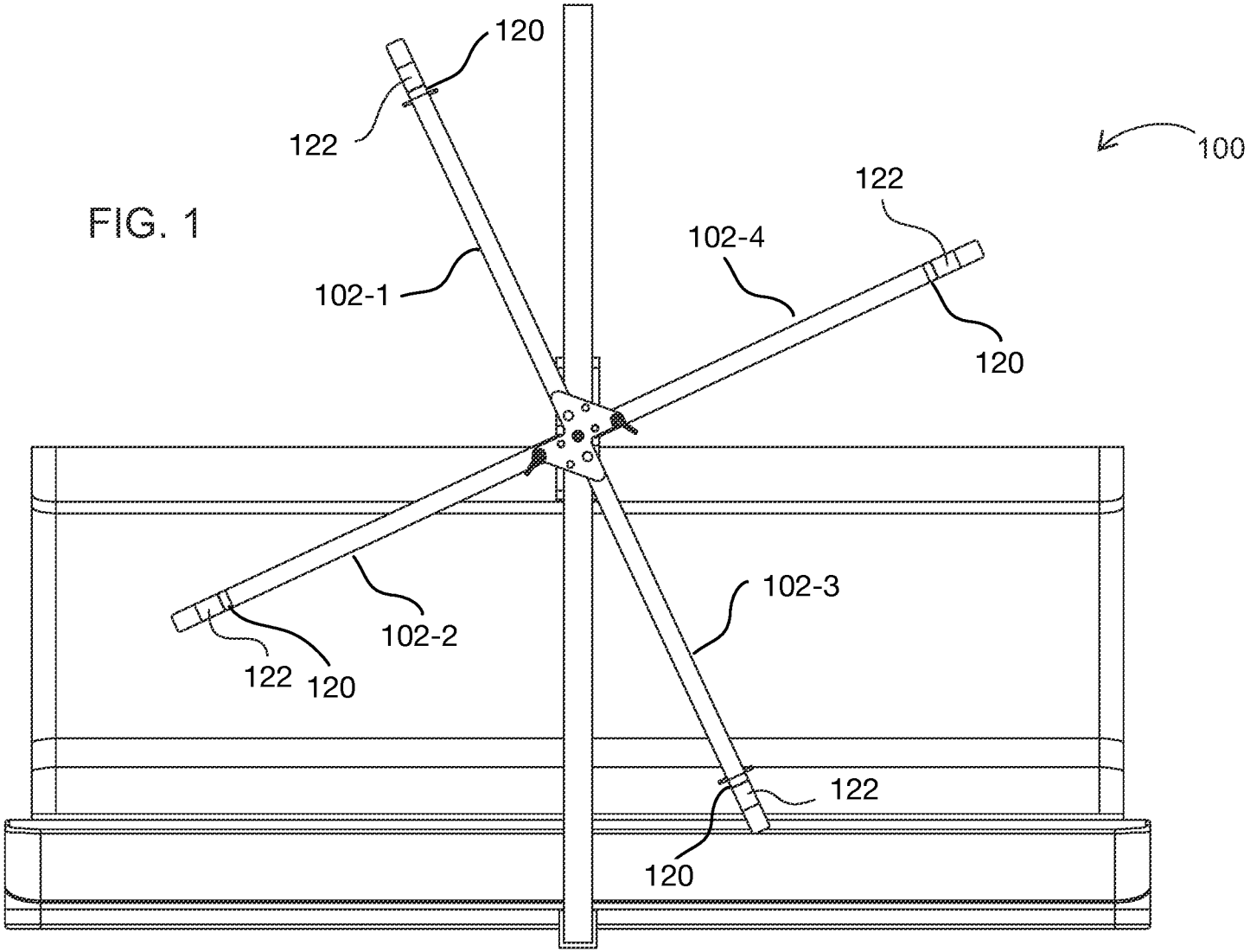
FIG. 1 shows an elevation view of the hose winder mounted to a trailer hitch on the back of a vehicle such as a pickup truck.
Figure 2:
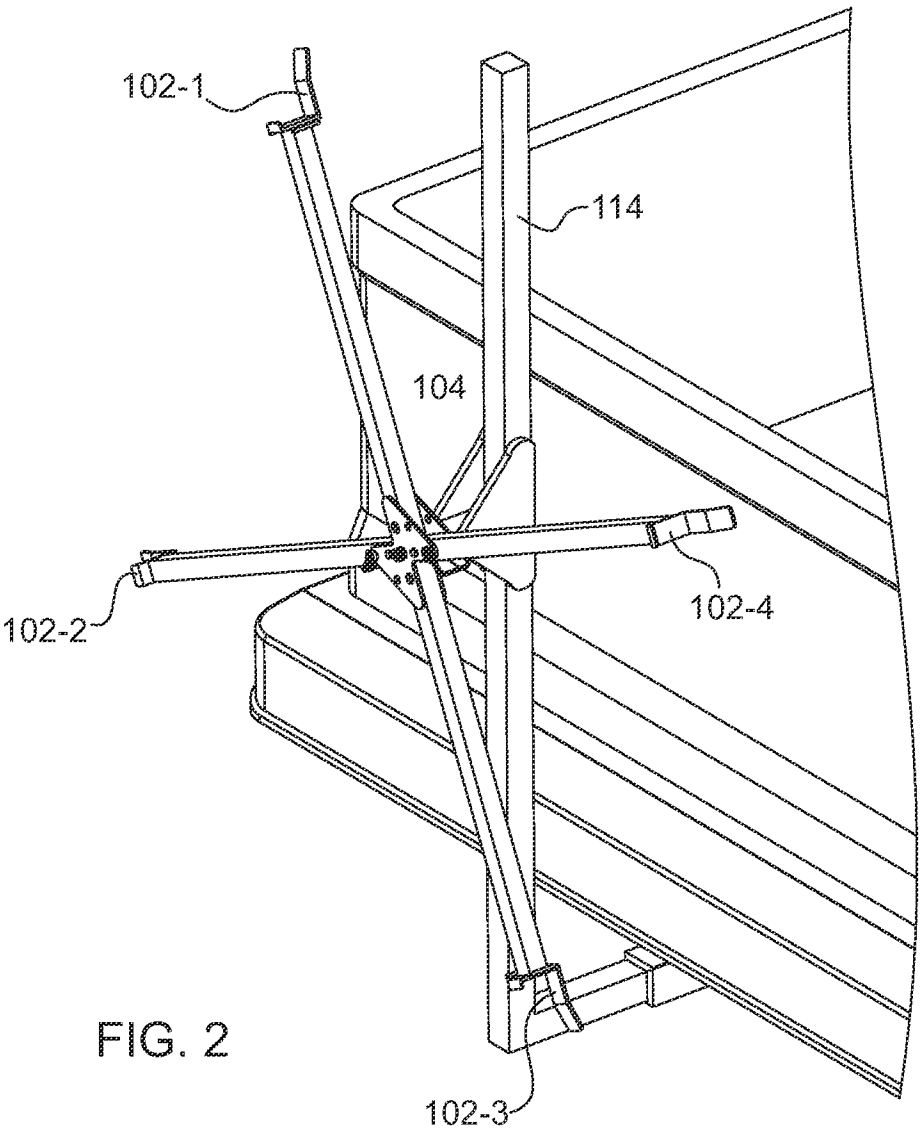
FIG. 2 shows a perspective view from the side of the hose winder shown in FIG. 1 also showing the firehose winder mounted on the trailer hitch of a vehicle.
Figure 3:
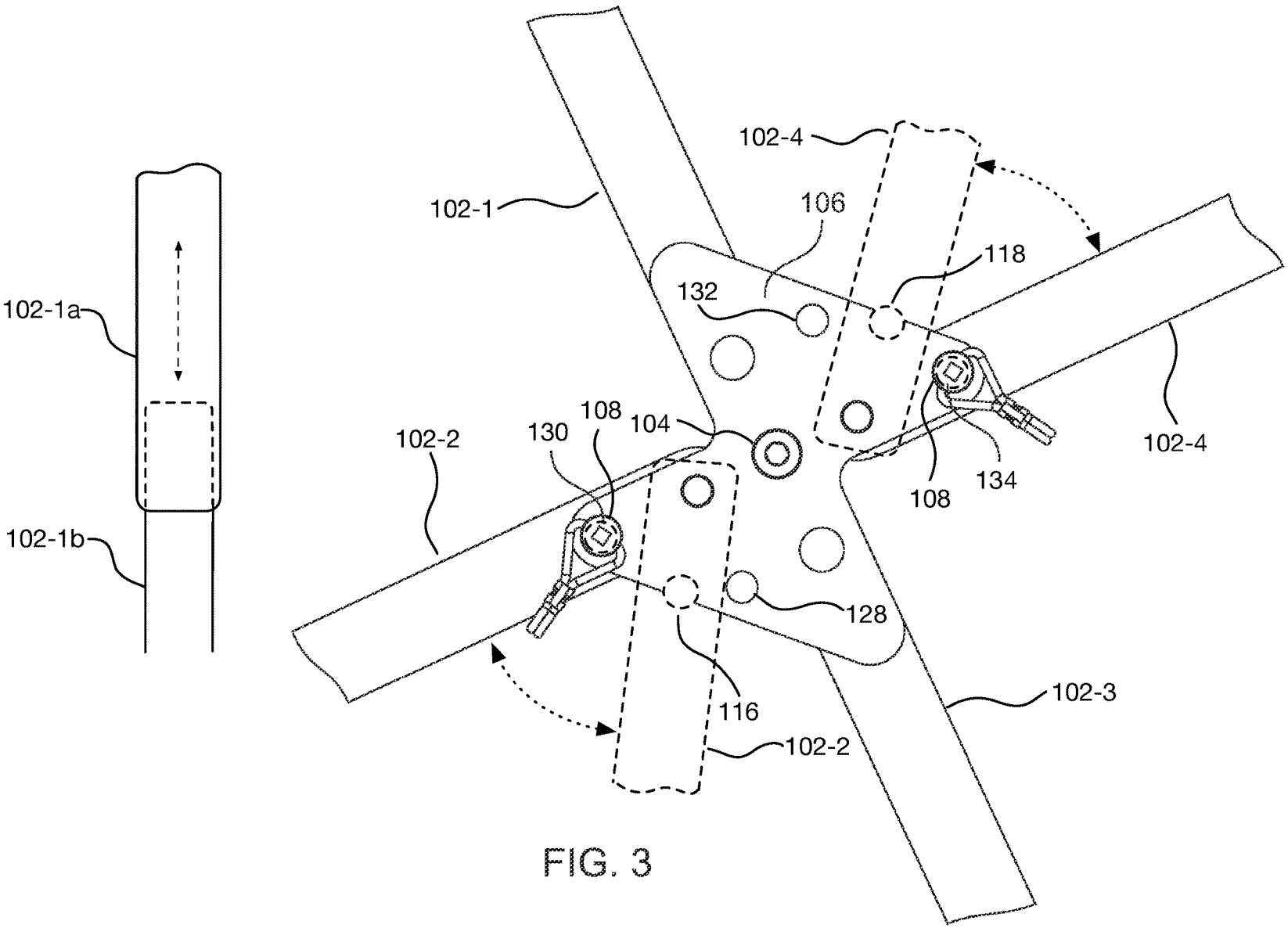
FIG. 3 shows a center hub of the hose winder shown in FIGS. 1-2.

Directing attention to the accompanying drawing FIGS. 1-14, the present invention provides a hose winding apparatus 100 that can be mounted on a vehicle's tow hitch or on a freestanding base and has a plurality of opposing arms 102-1, 102-2, 102-3, and 102-4 extending from a central pin 104 about which the arms 102-1 through 102-4 rotate. In the preferred embodiment, four arms are used to present two pairs of opposing arms, placed at 90 degrees with respect to each other to present the plurality of arms 102-1 through 102-4 in a "plus sign" or X-shaped orientation of the opposing arms as shown in FIG. 1. In one instance of the invention, the opposing arms 102-1 and 102-3 are fixedly mounted on a central hub member 106 that, in one instance of the invention, includes two flat plates 124 and 126 between which the arms 102-1 through 102-4 are held. The central hub member 106 is rotatably mounted on a central pin 104 (FIG. 6) and the opposing arms 102-2 and 102-4 are rotatably mounted on the central hub member 106 and may be rotated from a position lying against opposing arms 102-1 and 102-3 (FIG. 13) to a position perpendicular to opposing arms 1-2-1 and 102-3 (FIG. 3). The rotatable opposing arms 102-2 and 102-4 are retained in position by locking pins 108 placed through locking pin holes formed in the central hub member to allow coils of different lengths to be made as well as reducing the size of the winder for storage. The locking pin hole for arm 102-2 is shown in FIG. 3 in dashed lines 116 where arm 102-2 is also shown rotated to an intermediate position in dashed lines. The locking pin hole for arm 102-4 is also shown in FIG. 3 in dashed lines 118 where arm 102-4 is also shown rotated to an intermediate position in dashed lines. When the arm 102-2 is placed against the arm 102-1 it is held in place by a locking pin 108 inserted in a first locking pin hole 128 in the central hub 106. When the arm 102-2 is positioned perpendicular to arms 102-1 and 102-3 it is held in place by a locking pin 108 inserted in a second locking pin hole shown in dashed lines 130 under the locking pin 108 in the central hub 106. When the arm 102-4 is placed against the arm 102-3 it is held in place by a locking pin 108 inserted in a third locking pin hole 132 in the central hub 106. When the arm 102-4 is positioned perpendicular to arms 102-1 and 102-3 it is held in place by a locking pin 108 inserted in a second locking pin hole shown in dashed lines 134 under the locking pin 108 in the central hub 106. In an embodiment, at the end of each arm 102-1 through 102-4 is a substantially-perpendicular flange against which the flattened firehose 110 is wrapped. Flanges 112, at the ends of the opposing arms, define the beginning size of the coiled fire hose 110. Each of the flanges 112 of the first through fourth arms each comprise a generally L-shaped member including a first portion 120 perpendicular to the arm having a flat surface to accept a hose and a second portion 122 perpendicular to the first portion (shown in FIG. 7) to confine lateral movement of the hose as it is being wound. Operation begins with placing an end of a length of firehose on one of the flanges 112 located at the ends of the opposing arms. Opposing arms 102-1 through 102-4 are then rotated about the central pin 104, and the fire hose 110 is wrapped around the ends of opposing arms 102-1 through 102-4.

In an embodiment, each opposing arm 102-1 through 102-4 is constructed from two telescoping sections (shown as illustrative telescoping sections 102-1*a* and 102-1*b* within section 102-1*a* in FIG. 3 and moveable as shown by the dashed arrow) that can be fixed at different lengths to define larger or smaller coils of wound firehose. In an embodiment, opposing arms 102-1 through 102-4 are each constructed from a first piece with an at least one aperture in its length, and telescoping lengths attached to first piece by way of a pin placed through the aperture of the first piece and its telescoping length.

Central pin 104 defines the axis of rotation for the opposing arms 102-1 through 102-4 and protrudes from a vertical member 114 that supports the opposing arms 102-1 through 102-4 and fire hose 110 above the ground, for example from a freestanding base placed on the ground, or from a trailer hitch located typically near the rear bumper of a vehicle. Thus, the vertical member 114 is longer than the opposing arms with their telescoping extensions deployed so that there is clearance for the firehose to wrap around the flanges during rotation of the opposing arms.

Figure 4:
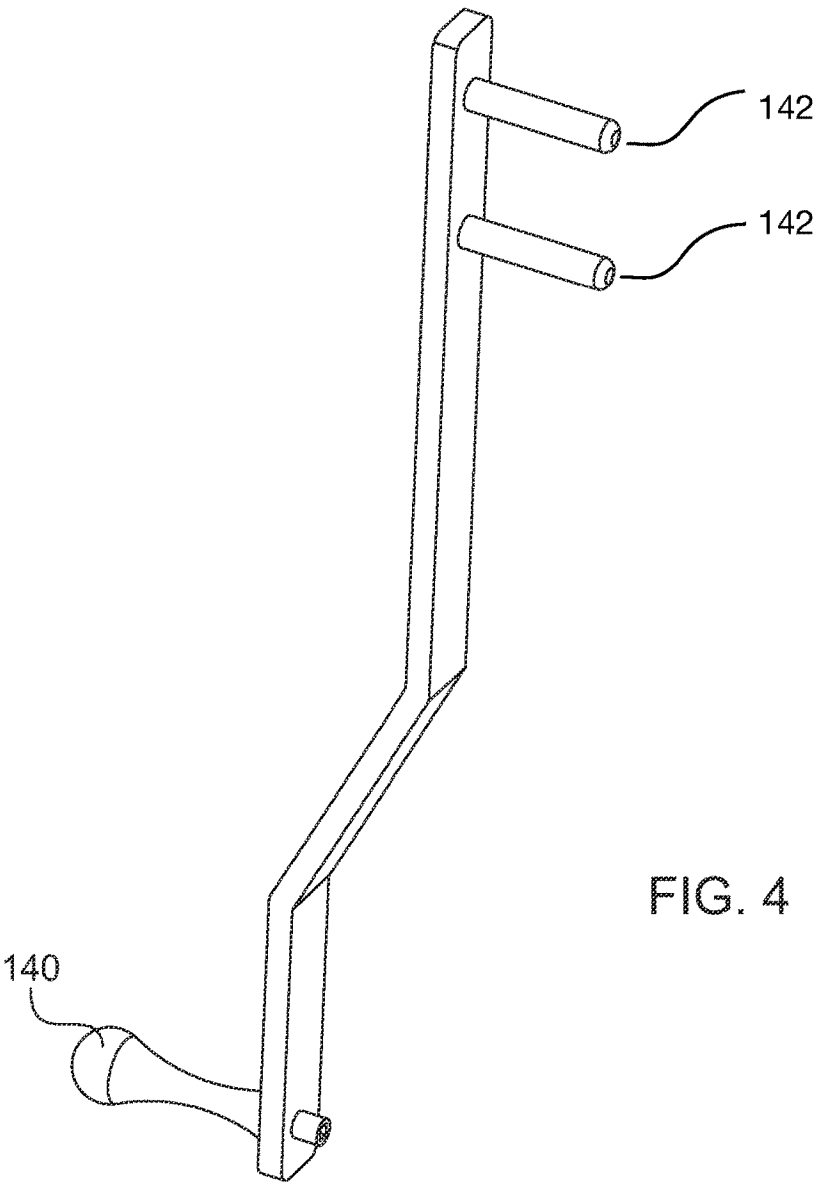
FIG. 4 shows a hand-crank tool used to rotate the hose winder when inserted into the center hub.
Figure 5:
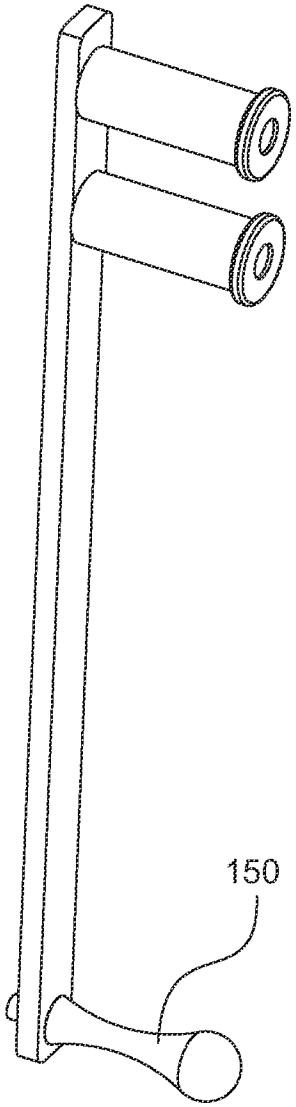
FIG. 5 shows a hose-flattening tool used with the hose winder.

Hand-crank tool 140 for rotating the hose winding apparatus 110 is shown in FIG. 4. Slightly different in structure from hand-crank tool 140 is a hose-flattening tool 160 (FIG. 5) that can be used during operation of the hose winding apparatus of the present invention. Hose-flattening tool 150 includes a handle attached to a piece of metal or other suitable material that has two large flattening pins 152 protruding in parallel from the tool. The fire hose 110 is passed through flattening tool 160 the hose is wound around the flanges of the opposing arms. As the fire hose 110 passes through the pair of flattening pins 152, it collapses into a flattened orientation that makes it easily wrapped in a coil. While hose-flattening tool 160 can be held in the hand of a user, in embodiments of the present invention, the tool can be mounted to or near the vertical member 114 that supports central pin 104 and rotating arms 102, so that one person can rotate arms 102-1 through 102-4 about central pin 104, with flattened hose being fed through the flattening pins 162 from the human force turning the apparatus to wind the fire hose 110.

Figure 6:
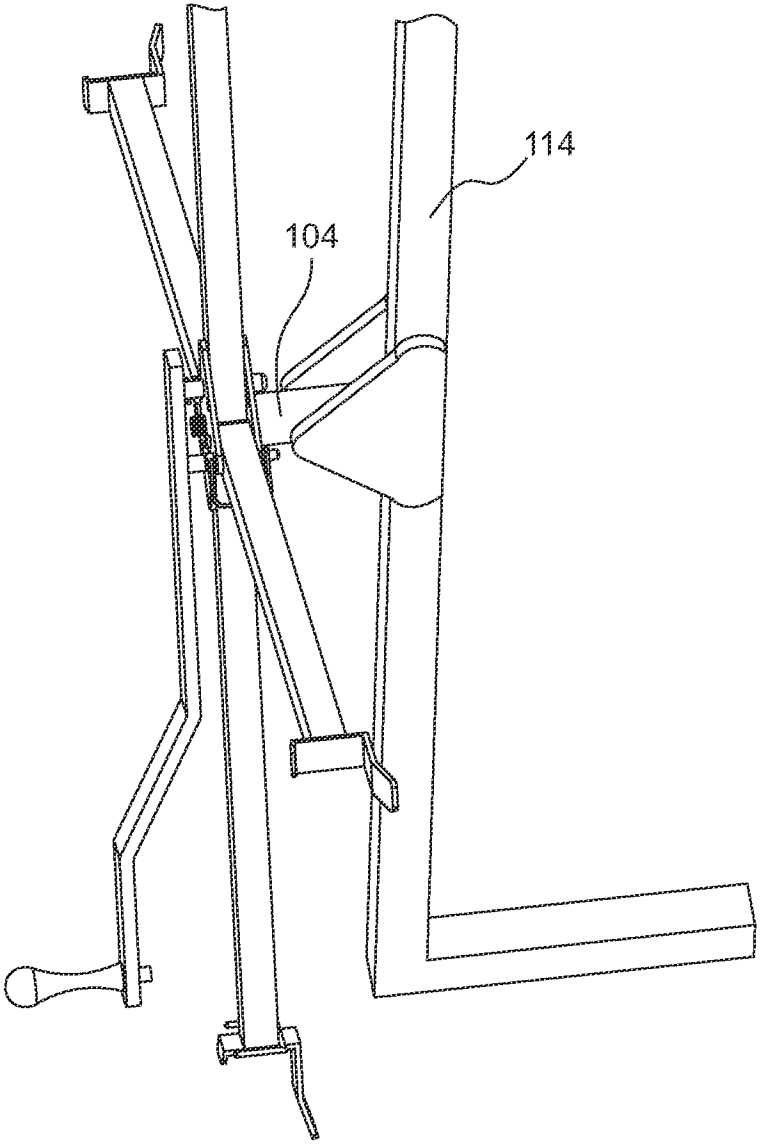
FIG. 6 shows the hand-crank tool of FIG. 4 inserted into the center hub of the hose winding apparatus.
Figure 7:
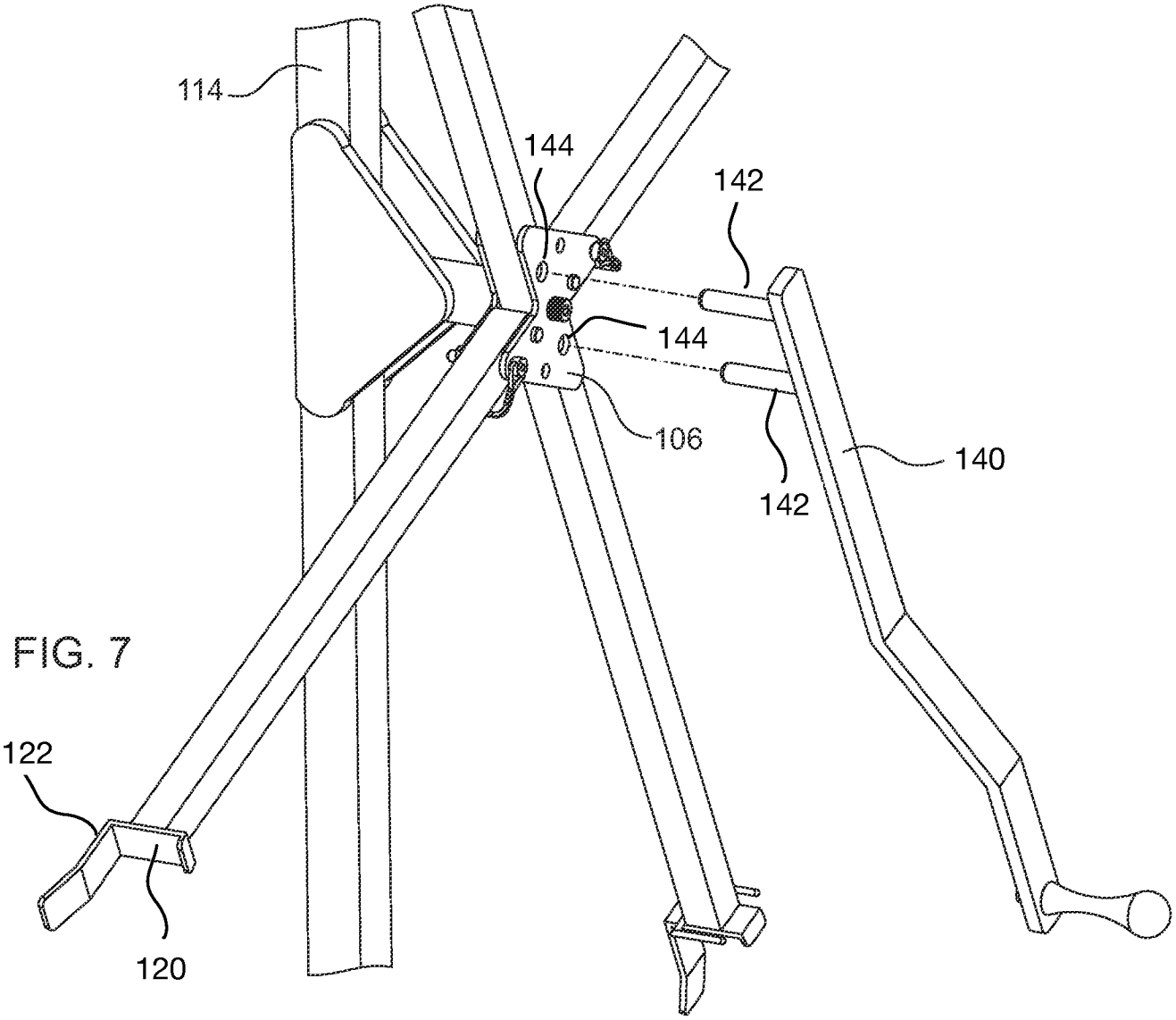
FIG. 7 shows an alternative perspective view of a portion of the firehose winding apparatus with the cranking tool positioned to be inserted into the center hub.

As shown in FIG. 6, hand-crank tool 140 is shown including a pair of spaced-apart engaging pins 142 that are inserted into the central hub member 16. As shown in FIG. 7, central hub member 106 can include two hand-crank-tool holes 144 to accept both engaging pins 142 pins on the crank handle. Hose is also wound in smaller rolls such as straight rolls (when the hose is rolled from one end to the other) and donut rolls (where the hose is folded in half and rolled from the middle toward the ends). Hose winding apparatus 100 is also capable of winding hose in these configurations.

Figure 8:
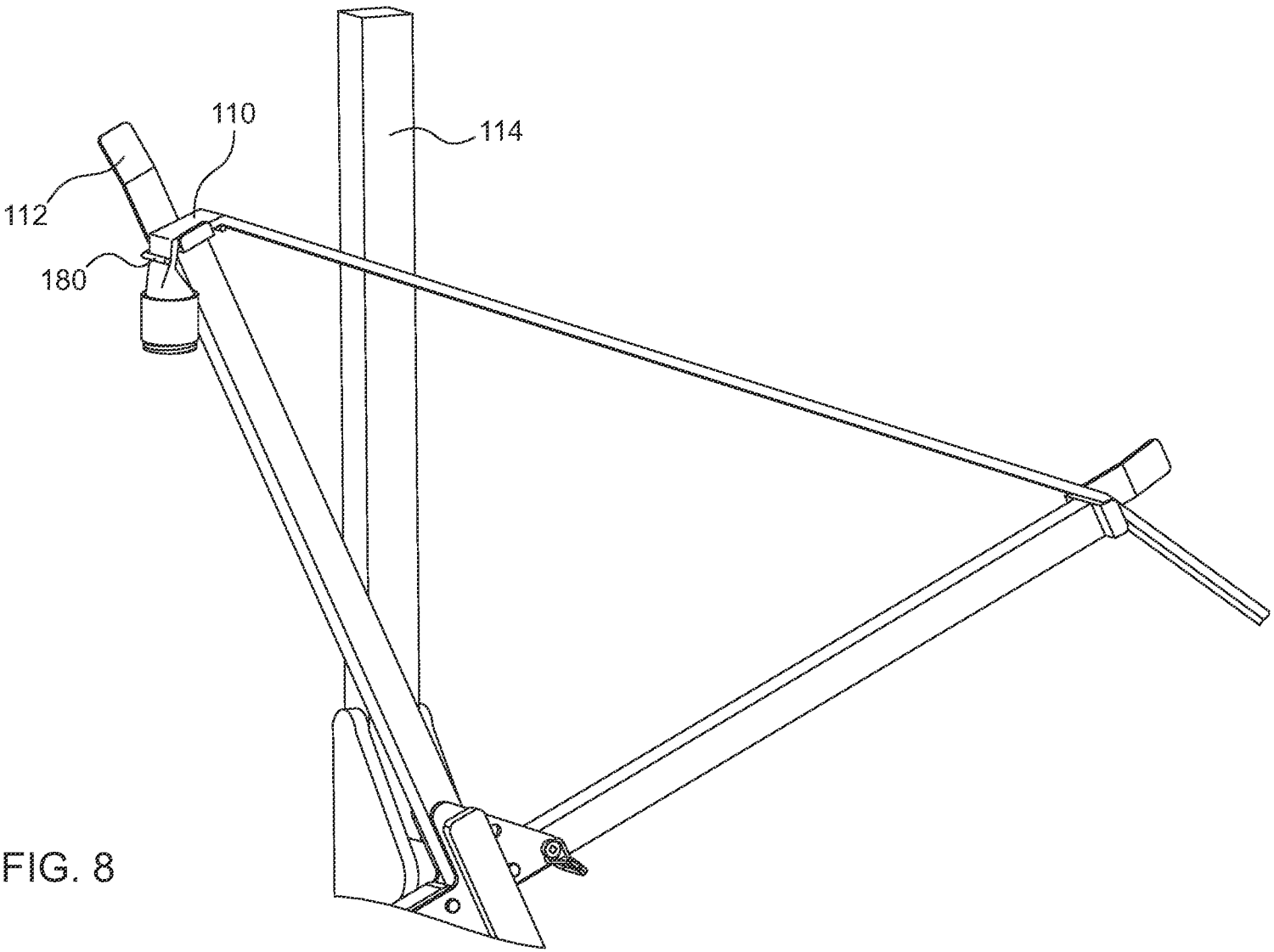
FIG. 8 shows a firehose end attached to an arm of the hose winding apparatus.

FIG. 8 shows one of opposing arms 102-1 through 102-4 retaining an end of a length of fire hose 110. A securing pin 180 retains the end of a length of firehose with a nozzle attached so that winding can begin.

Figure 9:
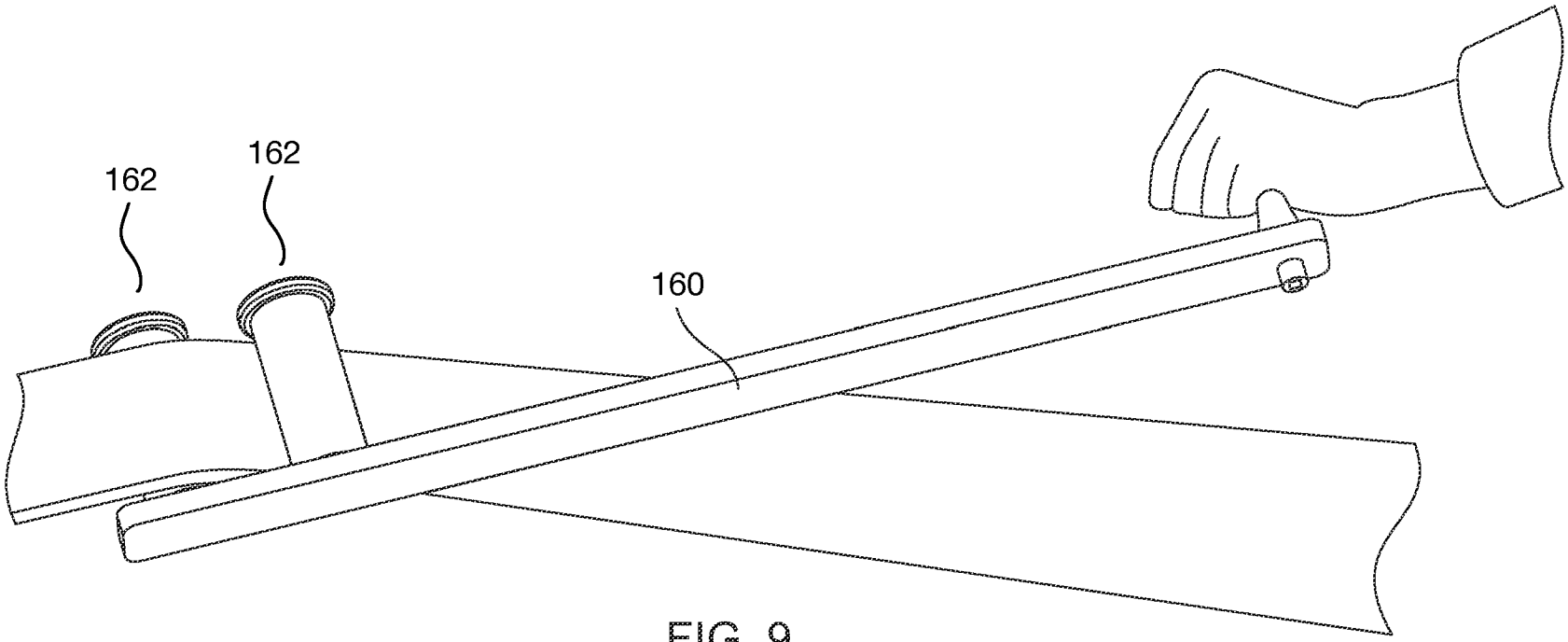
FIG. 9 shows a perspective view of the hose flattening tool.

FIG. 9 shows hose-flattening tool 160 with washers located on two guide pins 162 to retain fire hose 110 in place as it passes between pins 1162 52.

Figure 10:
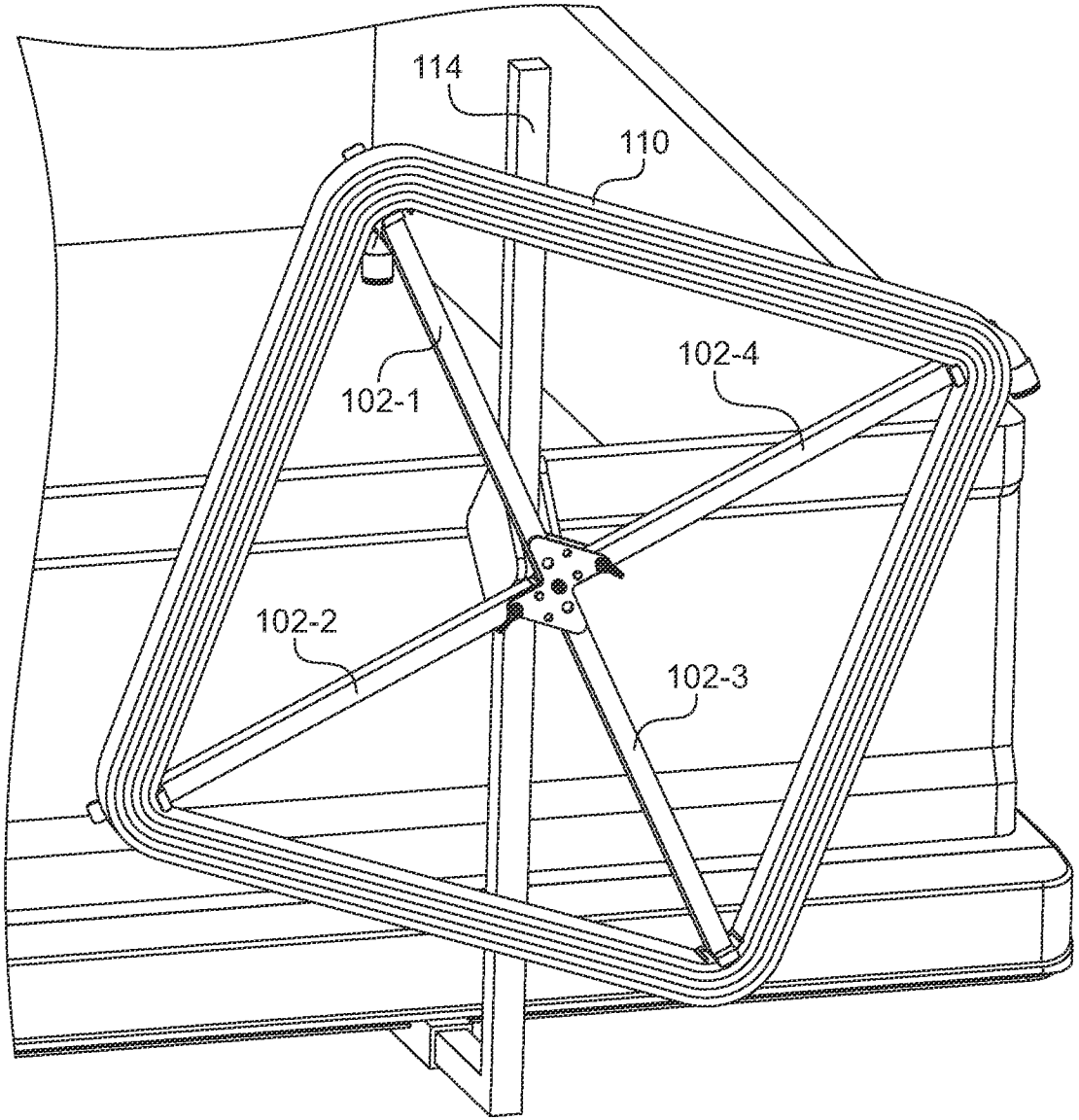
FIG. 10 shows a section of firehose completely wrapped around the hose winding apparatus.
Figure 11:
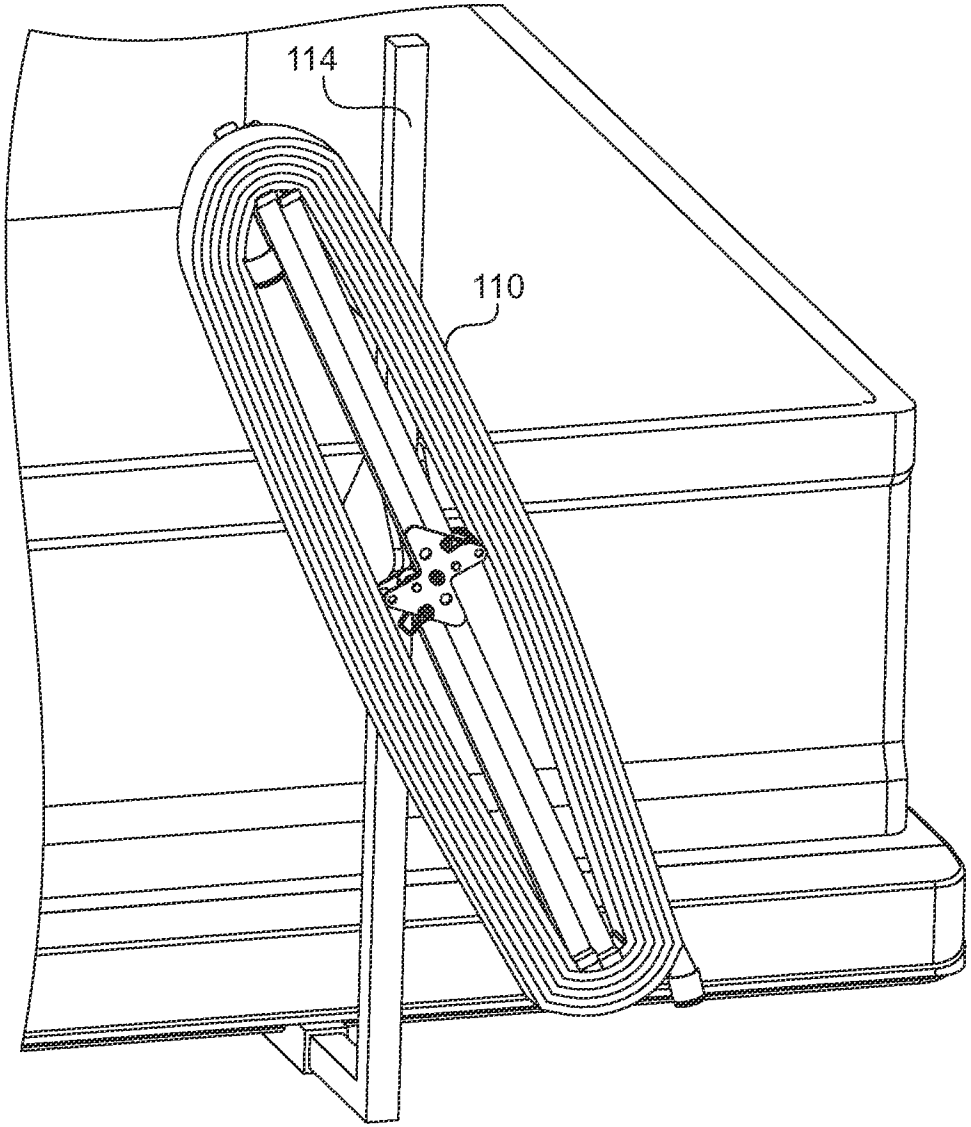
FIG. 11 shows a section of firehose completely wrapped around the firehose winding apparatus with two of the opposing arms rotated to a position against the other two opposing arms.

FIG. 10 shows fire hose 110 wrapped around opposing arms 102-1 through 102-4. While this configuration shows all four opposing arms extended, fire hose 110 can be wound around opposing arms 102-1 through 102-4 with arms 102-2 and 102-4 rotated against the other two opposing arms 102-1 and 102-3 respectively, as shown in FIG. 11.

Figure 12:
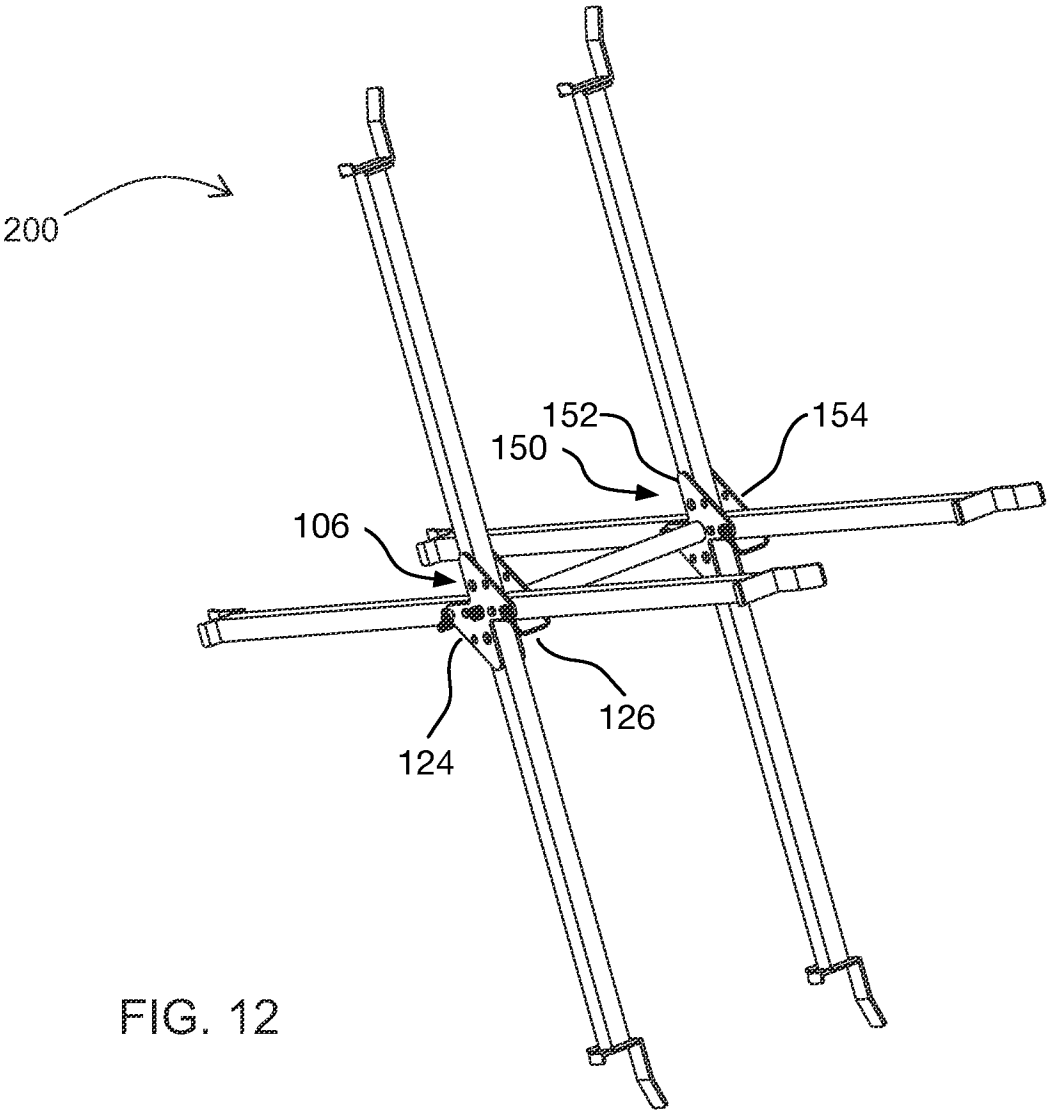
FIG. 12 shows an alternative embodiment of the firehose winding apparatus for simultaneously winding two firehoses.

FIG. 12 shows the alternative embodiment of a double-winding embodiment 200 wherein two coils of firehose can be wound simultaneously in parallel on a first central hub member 106 (shown including plates 124 and 126) and a second central hub member 150 (shown including plates 152 and 154). The second central hub member and its opposing arms may be configured identically to the one shown in, for example, FIGS. 1 through 3.

Figure 13:
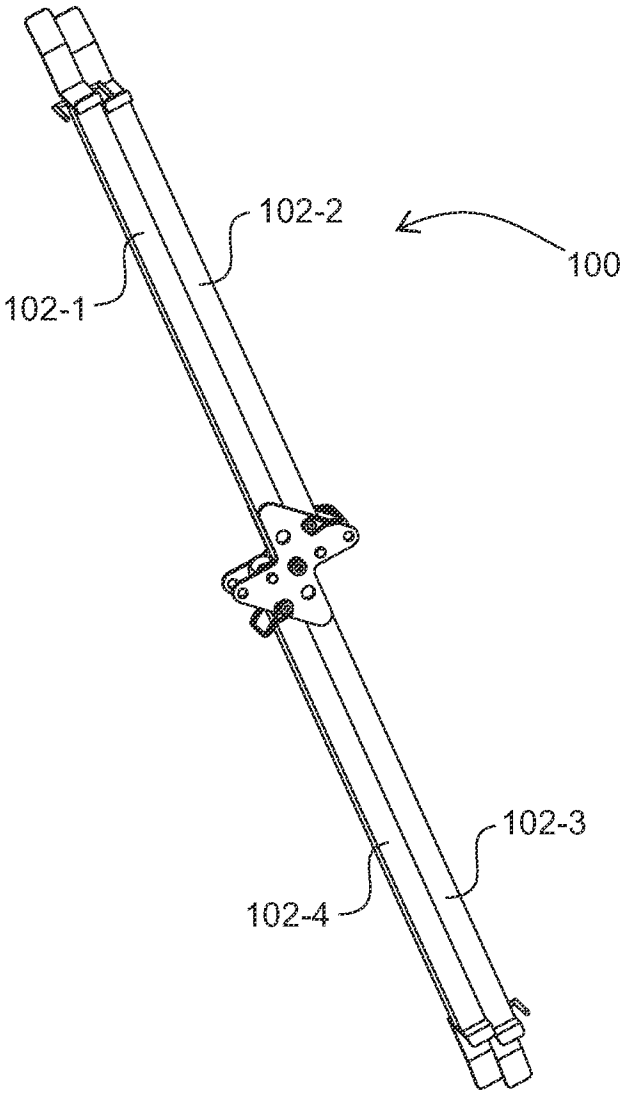
FIG. 13 shows the hose winding apparatus as shown in FIG. 11 with two of the four arms rotated to a position against the other two opposing arms, without the firehose wrapped around it.
Figure 14:
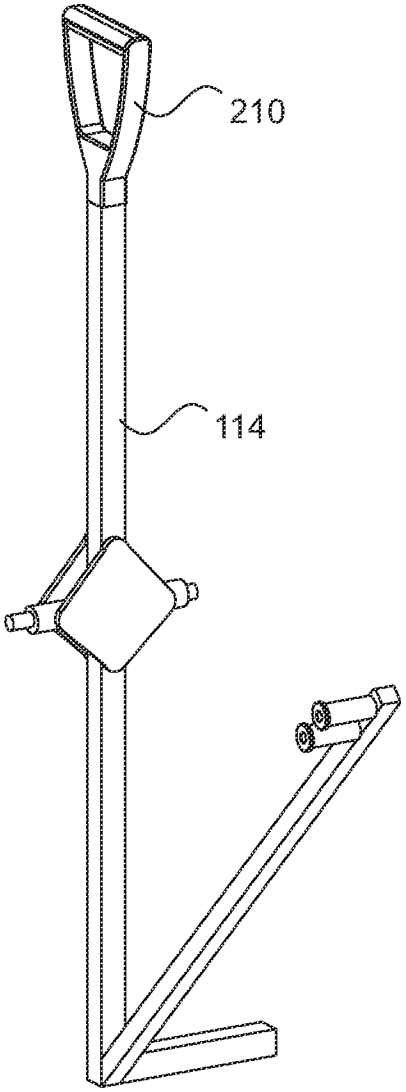
FIG. 14 shows a D-handle incorporated into the top of the hose winding apparatus.

FIG. 13 shows hose-winding apparatus 100 folded for storage and removed from central pin 104 and vertical member 114.

In an alternative embodiment, detachable D-handle 210 (FIG. 14) is attached to the top of the vertical member 112 to assist in stability when winding heavy hoses. D-handle 210 is useful for embodiments of the present invention using a freestanding base. As the firehose is wound, the user holds D-handle and prevents the apparatus from tipping over or moving out of position.

When the hose winding apparatus is no longer needed, the opposing arms are folded together by rotating them about their hinges on the central hinged member.

Once the arms are folded, the central hinged member and attached, folded arms are removed from the central pin and stored with the vertical member for transport or storage.

In an alternative embodiment, the central pin is at least twice as long as in the preferred embodiment, such that it protrudes through both sides of the vertical member and receives a second, similar hose winding apparatus on the rear side of the vertical member. This alternative embodiment is used for instances where the hose winding apparatus is not mounted on a tow hitch of a vehicle, but rather on a freestanding base that provides access to the rear-mounted second hose winding apparatus. In this embodiment, the opposing arms can be set at one length for one hose winding apparatus, and a different length for the second hose winding apparatus, so firehoses can be coiled in different sized coils, for example one size coil for a firefighter s backpack, and another, larger-sized coil for storage on a firetruck or at a fire station.

Also in this alternative embodiment, the opposing arms on either side of the vertical member can be of the same length, so that two similarly-sized coils can be formed simultaneously. As explained above, in instances where firehoses are laid for miles, or multiple firehoses are laid in parallel, a double-winding configuration of this alternative embodiment can be used at one location after another along the lengths of laid firehose.

The firehose winding apparatus of the present invention has been described and illustrated in detail. Numerous modifications can be made to the various embodiments of the present invention described herein without departing from the spirit thereof.

What is claimed is:

1. A firehose winding apparatus, comprising:

a support member;

a central hub member rotatably attached to the support member on an axis of rotation;

first and second opposing arms each attached to the central hub member at a first end thereof and having a flanged member at a second end thereof;

a third arm coupled to the central hub member at a first end thereof and pivotable from a first position against the first arm and a second position perpendicular to the first and second arms, and having a flanged member at a second end thereof;

a fourth arm coupled to the central hub member at a first end thereof and pivotable from a first position against the second arm and a second position opposite the second position of the third arm and perpendicular to the first and second arms, and having a flanged member at a second end thereof;

the central hub including a first locking pin hole positioned to be aligned with a locking pin hole in the third arm when it is positioned against the first arm and a second locking pin hole positioned to be aligned with the locking pin hole of the third arm when it is positioned perpendicular to the first and second arms; and the central hub including a third locking pin hole positioned to be aligned with a locking pin hole in the fourth arm when it is positioned against the second arm and a fourth locking pin hole positioned to be aligned with the locking pin hole of the third arm when it is positioned perpendicular to the first and second arms.

2. The firehose winding apparatus of claim 1 wherein:

the central hub comprises first and second plates;

the first and second arms are disposed between the first and second plates; and the third and fourth arms are pivotally mounted between the first and second plates.

3. The firehose winding apparatus of claim 1 wherein the flanged members of the first through fourth arms each comprise a generally L-shaped member including a first portion perpendicular to the arm having a flat surface to accept a hose and a second portion perpendicular to the first portion to confine lateral movement of the hose as it is being wound.

4. The firehose winding apparatus of claim 1 wherein the first through fourth arms are square in cross section.

5. The firehose winding apparatus of claim 1 wherein a bottom portion of the support member is configured to be received by a vehicle trailer hitch.

6. The firehose winding apparatus of claim 1 further comprising:

a cranking tool comprising a shaft having a hand grip extending at a first end in a first direction and a pair of spaced apart engaging pins extending at a second end in a direction opposite the first direction; and wherein the central hub further includes a pair of cranking tool holes spaced apart at a distance to accept the pair of spaced apart engaging pins of the cranking tool.

7. The firehose winding apparatus of claim 1 further comprising:

a hose flattening tool including a pair of flattening pins through which the hose may be passed before being wound around the first through fourth arms.

8. The firehose winding apparatus of claim 1 wherein each of the arms is formed by at least two telescoping sections that can be fixed in different positions to adjust the lengths of the arms.

9. The firehose winding apparatus of claim 1 further comprising:

an auxiliary central hub member rotatably attached to the support member on the axis of rotation of the central hub member;

first and second opposing arms each attached to the auxiliary central hub member at a first end thereof and having a flanged member at a second end thereof;

a third arm coupled to the auxiliary central hub member at a first end thereof and pivotable from a first position against the first arm and a second position perpendicular to the first and second arms, and having a flanged member at a second end thereof;

a fourth arm coupled to the auxiliary central hub member at a first end thereof and pivotable from a first position against the second arm and a second position opposite the second position of the third arm and perpendicular to the first and second arms, and having a flanged member at a second end thereof;

the auxiliary central hub including a first locking pin hole positioned to be aligned with the locking pin hole of the third arm when it is positioned against the first arm and a second locking pin hole positioned to be aligned with the locking pin hole of the third arm when it is positioned perpendicular to the first and second arms; and the auxiliary central hub including a third locking pin hole positioned to be aligned with the locking pin hole of the fourth arm when it is positioned against the second arm and a fourth locking pin hole positioned to be aligned with the locking pin hole of the third arm when it is positioned perpendicular to the first and second arms.

* * * * *